US008378916B2

(12) United States Patent
Quan et al.

(10) Patent No.: US 8,378,916 B2
(45) Date of Patent: Feb. 19, 2013

(54) SYSTEMS AND METHODS FOR PROVIDING A RECONFIGURABLE GROUNDPLANE

(75) Inventors: Clifton Quan, Arcadia, CA (US); Mark Hauhe, Hermosa, CA (US); Rohn Sauer, Encino, CA (US)

(73) Assignee: Raytheon Company, Waltham, MA (US)

( * ) Notice: Subject to any disclaimer, the term of this patent is extended or adjusted under 35 U.S.C. 154(b) by 339 days.

(21) Appl. No.: 12/795,092

(22) Filed: Jun. 7, 2010

(65) Prior Publication Data

US 2011/0298684 A1 Dec. 8, 2011

(51) Int. Cl.
*H01Q 1/48* (2006.01)

(52) U.S. Cl. ..... 343/846; 343/848

(58) Field of Classification Search ..... 343/846, 343/848

See application file for complete search history.

(56) References Cited

U.S. PATENT DOCUMENTS

| | | | | |
|---|---|---|---|---|
| 4,498,086 | A | 2/1985 | Sandler | |
| 5,014,022 | A | 5/1991 | Wolfson et al. | |
| 6,202,748 | B1 | 3/2001 | Carisella et al. | |
| 6,674,340 | B2 | 1/2004 | Quan et al. | |
| 6,870,511 | B2 | 3/2005 | Lynch et al. | |
| 6,906,680 | B2 * | 6/2005 | Rawnick et al. | 343/846 |
| 7,053,849 | B1 | 5/2006 | Pike et al. | |
| 7,262,734 | B2 | 8/2007 | Wood | |
| 2003/0132890 | A1 | 7/2003 | Rawnick et al. | |
| 2004/0125019 | A1 | 7/2004 | Rawnick et al. | |
| 2005/0017905 | A1 | 1/2005 | Rawnick et al. | |
| 2005/0048934 | A1 | 3/2005 | Rawnick et al. | |
| 2005/0237267 | A1 | 10/2005 | Brown et al. | |
| 2007/0188398 | A1 | 8/2007 | Mohuchy et al. | |

OTHER PUBLICATIONS

Lake, "Liquid Metal Antenna", http://www.hamdomain.com/lm-antenna/, Jun. 9, 2009 (4 pgs.).

Extended European Search Report for European Application No. 11161314.7, Extended European Search Report dated Sep. 15, 2011 and mailed Sep. 23, 2011 (8pgs.).

Office action for U.S. Appl. No. 12/617,509, filed Nov. 12, 2009, inventor Clifton Quan, et al., entitled "Switchable Microwave Fluidi Polarizer", Office action mailed Jun. 20, 2012 (11 pgs.).

* cited by examiner

*Primary Examiner* — Hoang V Nguyen
(74) *Attorney, Agent, or Firm* — Christie, Parker & Hale, LLP

(57) ABSTRACT

Systems and methods for providing a reconfigurable groundplane are provided. In one embodiment, the invention relates to an antenna assembly having a reconfigurable groundplane, the assembly including a radio frequency (RF) feed, a plurality of radiating elements, a plurality of interconnects, each coupling one of the plurality of radiating elements to the RF feed, a first groundplane positioned between the RF feed and the plurality of radiating elements, a second groundplane positioned between the RF feed and the plurality of radiating elements, the second groundplane including at least one cavity for enclosing a liquid metal.

25 Claims, 10 Drawing Sheets

FIG.16

FUSIBLE ALLOY MELTING POINTS

| COMPOSITION | °C | NAME |
|---|---|---|
| Cs 77.0, K 23.0 | −48 | |
| Hg 100 | −39 | |
| Ga 68.5, In 21.5, Sn 10 | −19 | GALINSTAN |
| K 78.0, Na 22.0 | −11 | NaK |
| Ga 62.5, In 21.5, Sn 16.0 | 10.7 | |
| Ga 69.8, In 17.6, Sn 12.5 | 10.8 | |
| Ga 100 | 30 | |
| Bi 40.63, Pb 22.1, In 18.1, Sn 10.65, Cd 8.2 | 46.5 | |
| Bi 32.5, In 51.0, Sn 16.5 | 60.5 | FIELD'S METAL |
| Bi 50.0, Pb 25.0, Sn 12.5, Cd 12.5 | 70 | WOOD'S METAL |
| Bi 50.0, Pb 31.2, Sn 18.8 | 97 | NEWTON'S METAL |
| Bi 50.0, Pb 28.0, Sn 22.0 | 109 | ROSE'S METAL |
| Sn 63.0, Pb 37.0 | 183 | EUTECTIC SOLDER |
| Sn 92.0, Zn 8.0 | 199 | TIN FOIL |

SYSTEMS AND METHODS FOR PROVIDING A RECONFIGURABLE GROUNDPLANE

FIELD

This invention relates to a reconfigurable groundplane, and more specifically, to systems and methods for providing a reconfigurable groundplane for a wide band conformal radiator.

BACKGROUND

Future active array antennas for platforms such unmanned airborne vehicles (UAVs) will require increased reconfigurabity to enhance performance, wide tunable frequency bandwidth and signature. In many applications, a groundplane needs to be placed behind the radiators of such antennas to shield any back side electronics and to enhance RF antenna performance. For optimum performance the distance between the groundplane and radiators should be kept to an electrical distance of a quarter wavelength. The problem is that the physical dimension for a quarter wavelength is fixed for a given frequency, thus the electrical distance will vary as the frequency changes across a wide band. The result is performance degradation of the antenna aperture as the electrical distance changes between the groundplane and wide band radiators.

FIG. 17 shows an illustration of a convention active phase array antenna. Typical installation on a platform requires that a groundplane be placed behind the radiators to provide RF shielding for the electronics and transmission lines located behind the aperture (i.e., TR module, phase shifters, manifolds, etc.). For a frequency bandwidth up to an octave, placement of the groundplane behind the radiator by one quarter of a wavelength at the center frequency provides optimum enhancement of the radiator performance.

Recently, wideband radiating element such as spirals, flare dipoles and long slots with greater than 5 to 1 frequency bandwidths are being used to realize ultra-wideband active arrays. As the frequency band increases, the quarter wavelength spacing between the radiator and the groundplane can no longer be maintained and the result is degradation of the radiator/array antenna performance due to interaction between the radiator and the groundplane.

SUMMARY

Aspects of the invention are directed to systems and methods for providing a reconfigurable groundplane. In one embodiment, the invention relates to an antenna assembly having a reconfigurable groundplane, the assembly including a radio frequency (RF) feed, a plurality of radiating elements, a plurality of interconnects, each coupling one of the plurality of radiating elements to the RF feed, a first groundplane positioned between the RF feed and the plurality of radiating elements, a second groundplane positioned between the RF feed and the plurality of radiating elements, the second groundplane including at least one cavity for enclosing a liquid metal.

In another embodiment, the invention relates to an antenna assembly having a reconfigurable groundplane, the assembly including a radio frequency (RF) feed, a plurality of radiating elements, and a plurality of interconnects, each coupling one of the plurality of radiating elements to the RF feed, and wherein the reconfigurable groundplane is positioned between the RF feed and the plurality of radiating elements, the reconfigurable groundplane including at least one cavity for enclosing a liquid metal.

In yet another embodiment, the invention relates to a method for operating a reconfigurable groundplane of an antenna assembly including a radio frequency (RF) feed coupled by interconnects to a plurality of radiating elements, the method including substantially filling, in a first mode, a cavity of the reconfigurable groundplane with a liquid metal, wherein the reconfigurable groundplane is positioned between the RF feed and the radiating elements, and substantially emptying, in a second mode, the cavity.

BRIEF DESCRIPTION OF THE DRAWINGS

FIG. 16 is a table of melting points for various alloys that might be used as a liquid metal in accordance with one embodiment of the invention.

DETAILED DESCRIPTION

Figure 2:
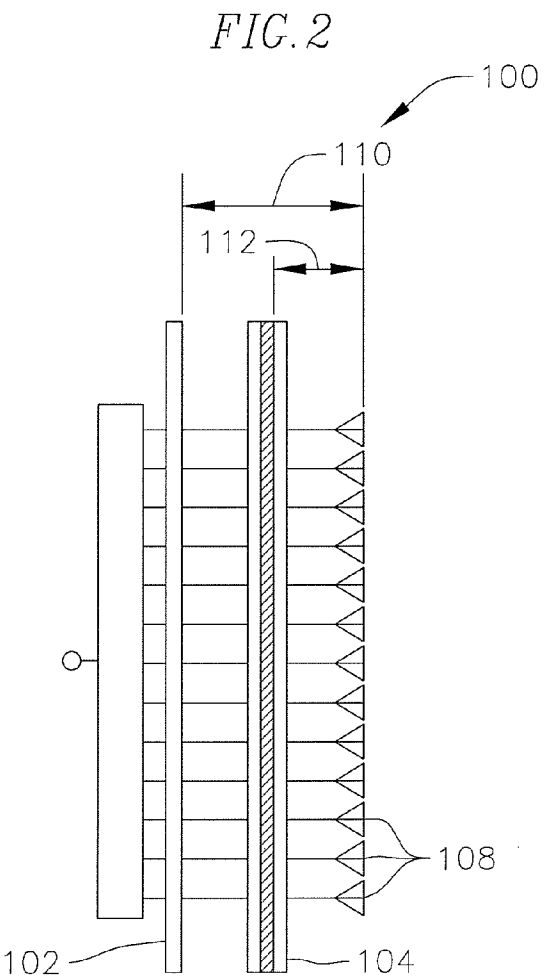
FIG. 2 is a side view of the an antenna assembly of FIG. 1 illustrating the reconfigurable groundplane, in a non-transparent or active mode, in accordance with one embodiment of the invention.

Referring now to the drawings, embodiments of antenna assemblies include reconfigurable groundplanes integrated within the assemblies that enable optimization of the antenna performance at different preselected frequencies across its tunable bandwidth. Embodiments of the reconfigurable groundplanes are operated in either a passive/transparent mode or an active/non-transparent mode. Embodiments of the reconfigurable groundplanes include at least one cavity for enclosing a liquid metal and can be positioned between an RF feed and radiating elements. In the active mode, the cavity is substantially filled with a liquid metal thereby adjusting a preselected frequency for optimum antenna performance. In the passive mode, the cavity is substantially empty of the liquid metal thereby minimizing the effect of the reconfigurable groundplane on the antenna performance.

In several embodiments, the antenna assemblies include a non-reconfigurable groundplane positioned at a quarter wavelength from the radiating elements for a first preselected frequency. In such case, the reconfigurable groundplane is positioned at a quarter wavelength for a second preselected frequency, where the second preselected frequency is typically greater than the first preselected frequency. In this case, when the reconfigurable groundplane is substantially empty, the reconfigurable groundplane is effectively passive and antenna performance is substantially dictated by the non-reconfigurable groundplane. As such, an optimum antenna performance can be achieved at the first preselected frequency. When the reconfigurable groundplane is substantially filled with liquid metal, the reconfigurable groundplane is active and antenna performance is substantially dictated by both the reconfigurable and non-reconfigurable groundplanes. As such, an optimum antenna performance can be achieved at a different frequency that is higher than first preselected frequency.

In another embodiment, the reconfigurable groundplane includes a first cavity positioned at a quarter wavelength for a second preselected frequency and a second cavity positioned at a quarter wavelength for a third preselected frequency, where the third preselected frequency is greater than the second preselected frequency. In such case, the reconfigurable groundplane has three modes of operation where each mode provides optimum antenna performance at a different preselected frequency.

Figure 1:
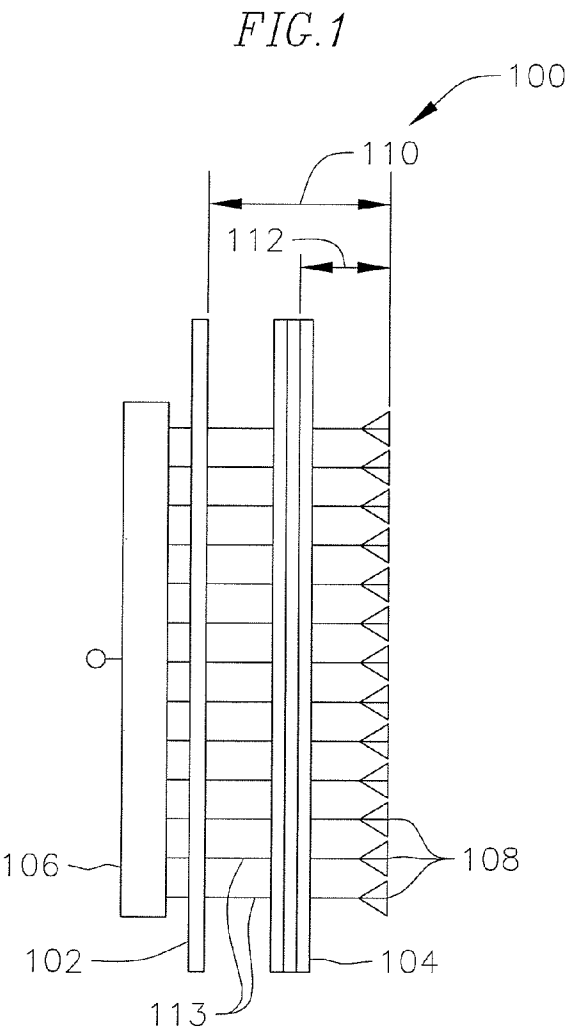
FIG. 1 is a side view of an antenna assembly including a first groundplane and a reconfigurable groundplane, in a transparent or passive mode, positioned between an RF feed and multiple radiating elements in accordance with one embodiment of the invention.

FIG. 1 is a side view of an antenna assembly 100 including a first groundplane 102 and a reconfigurable groundplane 104, in a transparent or passive mode, positioned between an RF feed 106 and multiple radiating elements 108 in accordance with one embodiment of the invention. The first groundplane 102 is positioned between the RF feed 106 and the reconfigurable groundplane 104 and at one quarter of a wavelength 110 at a first preselected center frequency. The first groundplane provides RF shielding for electronic components and transmission lines that are part of or located on the RF feed 106. These electronic components can include, for example, TR modules, phase shifters, manifolds, and other similar components. For a given frequency bandwidth, placement of the first groundplane behind the radiating elements by a quarter of a wavelength at the first preselected center frequency provides optimum enhancement of the radiator performance (e.g., antenna performance) at the first preselected frequency.

The reconfigurable groundplane 104 is positioned between the first groundplane 102 and the radiating elements 108 at one quarter of a wavelength 112 at a second preselected center frequency. The reconfigurable groundplane 104 includes two dielectric substrates enclosing a center cavity for retaining a liquid metal or a dielectric material. In a passive mode, the reconfigurable groundplane 104 is substantially empty of the liquid metal and appears transparent to energy travelling between the RF feed 106 and the radiating elements 108, along the interconnects 113 or otherwise. In an active mode, the reconfigurable groundplane 104 is substantially filled with liquid metal and acts as a conventional groundplane for energy travelling between the RF feed 106 and the radiating elements 108. In such case, the optimum antenna performance is achieved at a higher frequency than the optimum antenna performance when the reconfigurable groundplane is in the passive mode. As such, the reconfigurable antenna enables optimum performance at different center frequencies and across a wider frequency range than conventional antenna assemblies.

In the embodiment illustrated in FIG. 1, the interconnects 113 extend through clearance holes (see 122 in FIG. 3) in both the first groundplane 102 and the reconfigurable groundplane 104. In other embodiments, the interconnects 113 do not extend through clearance holes of the groundplanes. In one embodiment, the interconnects 113 are positioned beyond a perimeter of the groundplanes. In another embodiment, the groundplanes have a comb like shape with the interconnects interleaved between the comb teeth. In one similar embodiment, the groundplane can be formed to appear as thin closely spaced wires by forming the cavities into thin channels whose directions are perpendicular to the radiator polarization depending of the size of the desired channels to be formed. An example of such a system is described in U.S. patent application Ser. No. 12/617,509, entitled, "SWITCHABLE MICROWAVE FLUIDIC POLARIZER", the entire content of which is incorporated herein by reference. In other embodiments, other suitable shapes can be used.

In the embodiment illustrated in FIG. 1, the reconfigurable groundplane can be filled with a liquid metal in the active mode. Non-limiting examples of liquid metals such as fusible alloys are illustrated in FIG. 16. In several embodiments, the liquid metal is a fusible alloy than can remain liquefied at a relatively low temperature. In one embodiment, the liquid metal is any of the top three liquid metals listed in the table shown in FIG. 16. In some embodiments, for example, the liquid metal is Galinstan. In one such embodiment, a coating of Gallium Oxide is applied to the dielectric cavity to prevent wetting. In other embodiments, the liquid metal may be replaced with another suitable conductive fluid. In some embodiments, the reconfigurable groundplane can be filled with a first liquid metal in a first mode and a second liquid metal in a second mode. In such case, the first and second liquid metals can have sufficiently different characteristics as to provide additional flexibility in the optimum performance characteristic of the antenna assembly.

In the embodiment illustrated in FIG. 1, the antenna assembly includes a first or conventional groundplane 102. In some embodiments, the first groundplane can be removed. In one such embodiment, it is replaced by a reconfigurable groundplane having multiple fluidic cavities (see, for example, FIG. 6).

FIG. 2 is a side view of the antenna assembly 100 of FIG. 1 illustrating the reconfigurable groundplane 104, in a non-transparent or active mode, in accordance with one embodiment of the invention. In the active mode, the reconfigurable groundplane 104 is substantially filled with a liquid metal such that the reconfigurable groundplane 104 performs similar to a conventional groundplane. The groundplane that is formed with the liquid metal within the cavity can be quasi-continuous and smooth with the exception of the clearance holes to accommodate interconnect routing.

Figure 3:
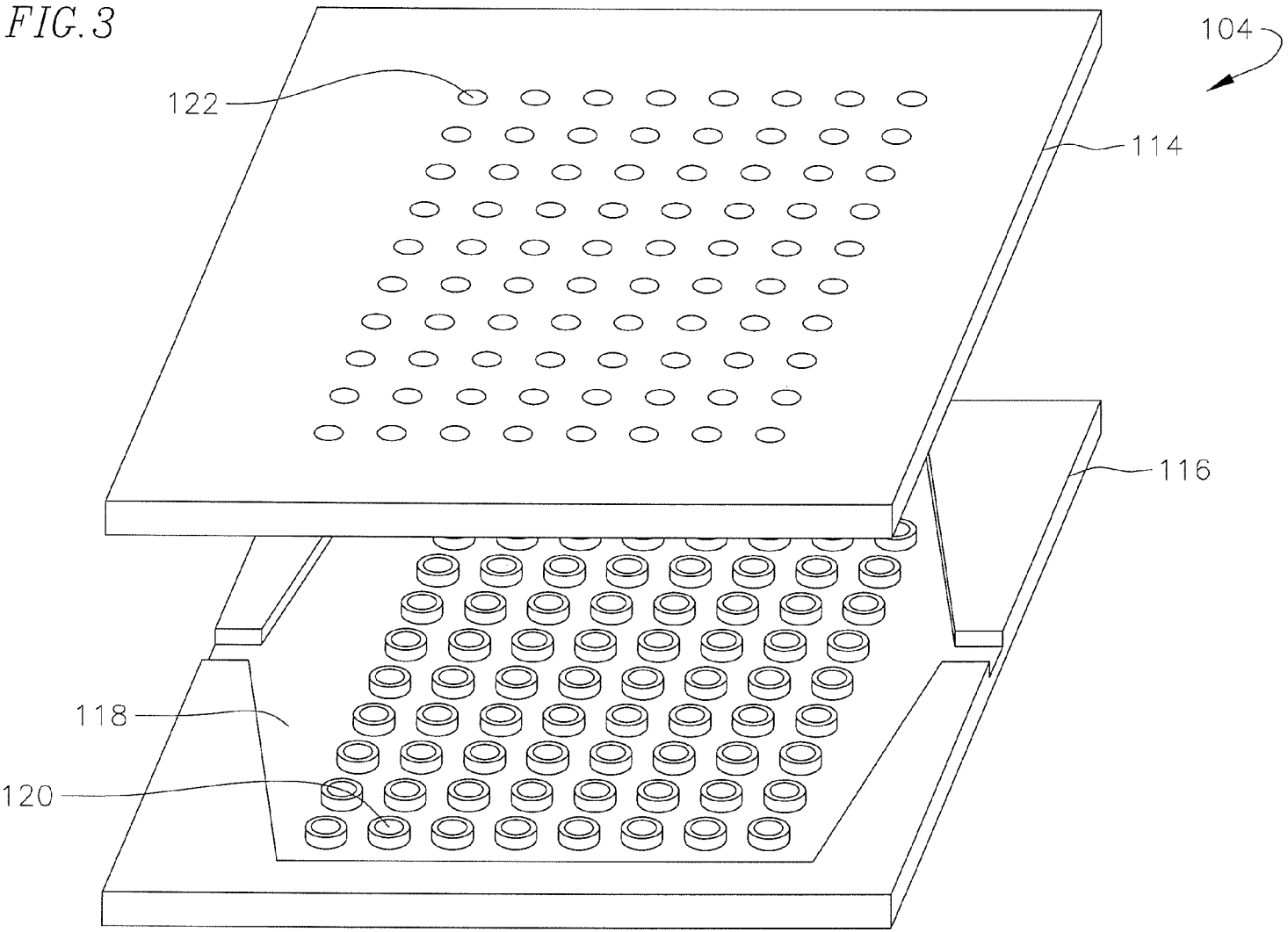
FIG. 3 is a perspective exploded view of a reconfigurable groundplane including two dielectric substrates forming a cavity for retaining a fluid and multiple apertures for forming clearance holes in accordance with one embodiment of the invention.

FIG. 3 is a perspective exploded view of a reconfigurable groundplane 104 including two dielectric substrates (114, 116) forming a cavity 118 for retaining a fluid and multiple apertures 120 for forming clearance holes 122 in accordance with one embodiment of the invention. In the embodiment illustrated in FIG. 3, the fluid cavity 118 surrounds the apertures 120 or dielectric bosses that structurally support the cavity. In other embodiments, other configurations of the apertures and cavity can be used. In one embodiment, for example, the apertures 120 can surround the cavity 118. In another embodiment, no apertures are used and the interconnects are routed around the dielectric substrates. In many embodiments, the dielectric substrates (114, 116) are machined to form the cavity 118 and dielectric bosses 120. In addition, the dielectric substrates (114, 116) are fused or bonded together using techniques known in the art for fusing dielectric materials. Examples of thin fusible dielectric sheets include silicon glass, polished ceramics, printed circuit board materials, and other suitable dielectric sheet materials. In the embodiment illustrated in FIG. 3, the area of the apertures 120 is smaller than the area of the fluidic groundplane or cavity 118. In other embodiments, the area of the apertures can be greater than or equal to the area of the fluidic groundplane or cavity.

Figure 4:
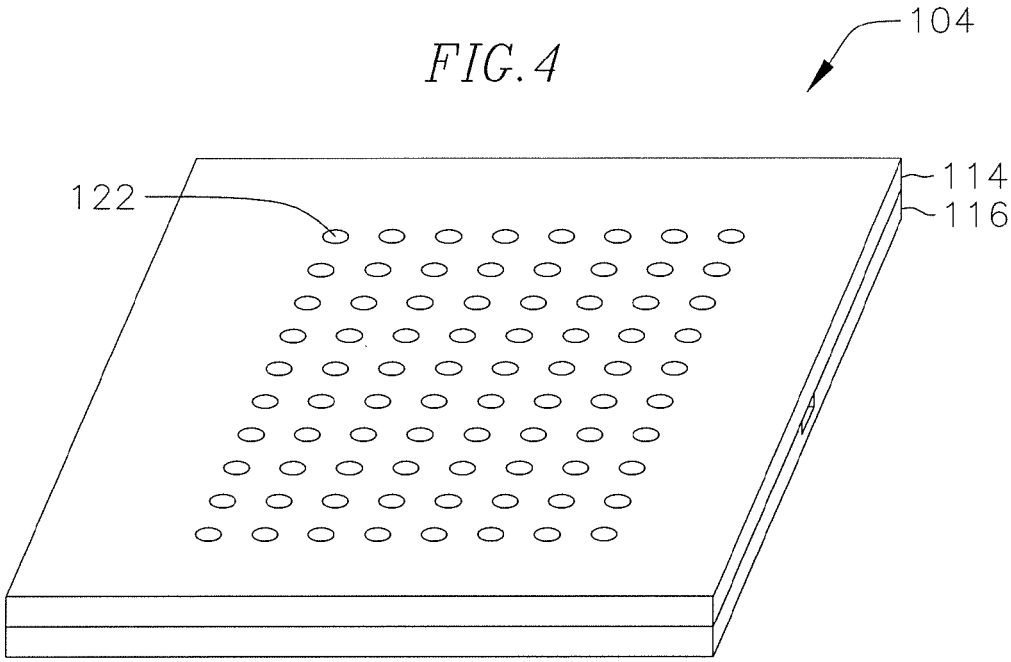
FIG. 4 is a perspective view of the reconfigurable groundplane of FIG. 3 illustrating the dielectric substrates fused together to seal the fluid cavity and form the clearance holes in accordance with one embodiment of the invention.

FIG. 4 is a perspective view of the reconfigurable groundplane 104 of FIG. 3 illustrating the dielectric substrates (114, 116) fused together to seal the fluid cavity and form the clearance holes 122 in accordance with one embodiment of the invention.

Figure 5:
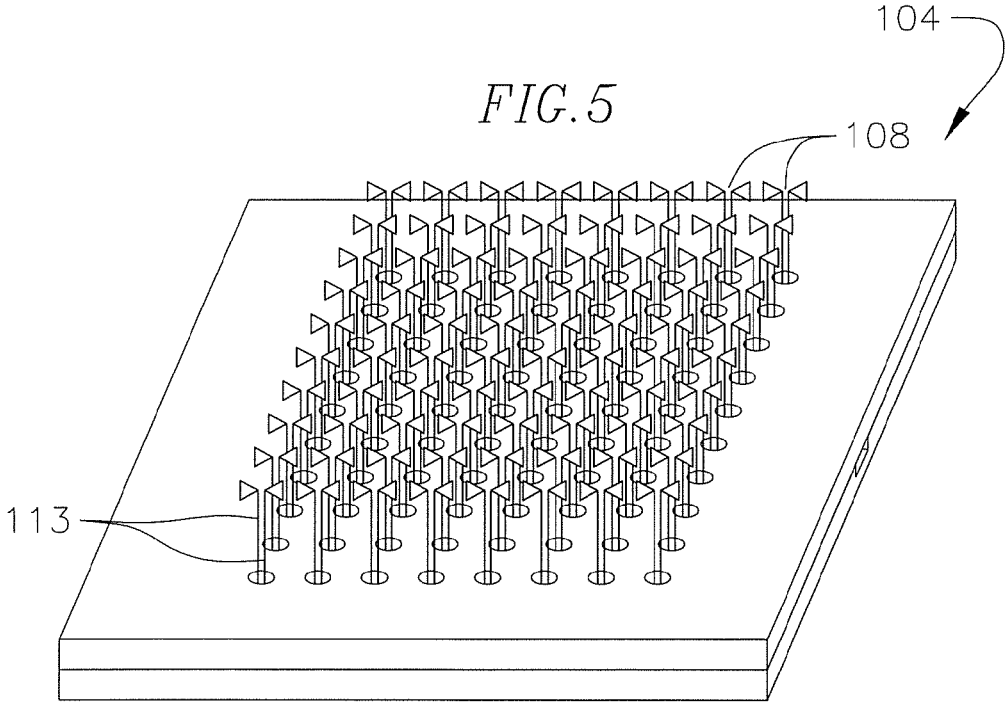
FIG. 5 is a perspective view of the reconfigurable groundplane of FIG. 4 illustrating a number of radiator interconnects extending through the clearance holes to radiating elements in accordance with one embodiment of the invention.

FIG. 5 is a perspective view of the reconfigurable groundplane 104 of FIG. 4 illustrating a number of radiator interconnects 113 extending through the clearance holes 122 to the radiating elements 108 in accordance with one embodiment of the invention.

Figures 6, 7, 8, 9:
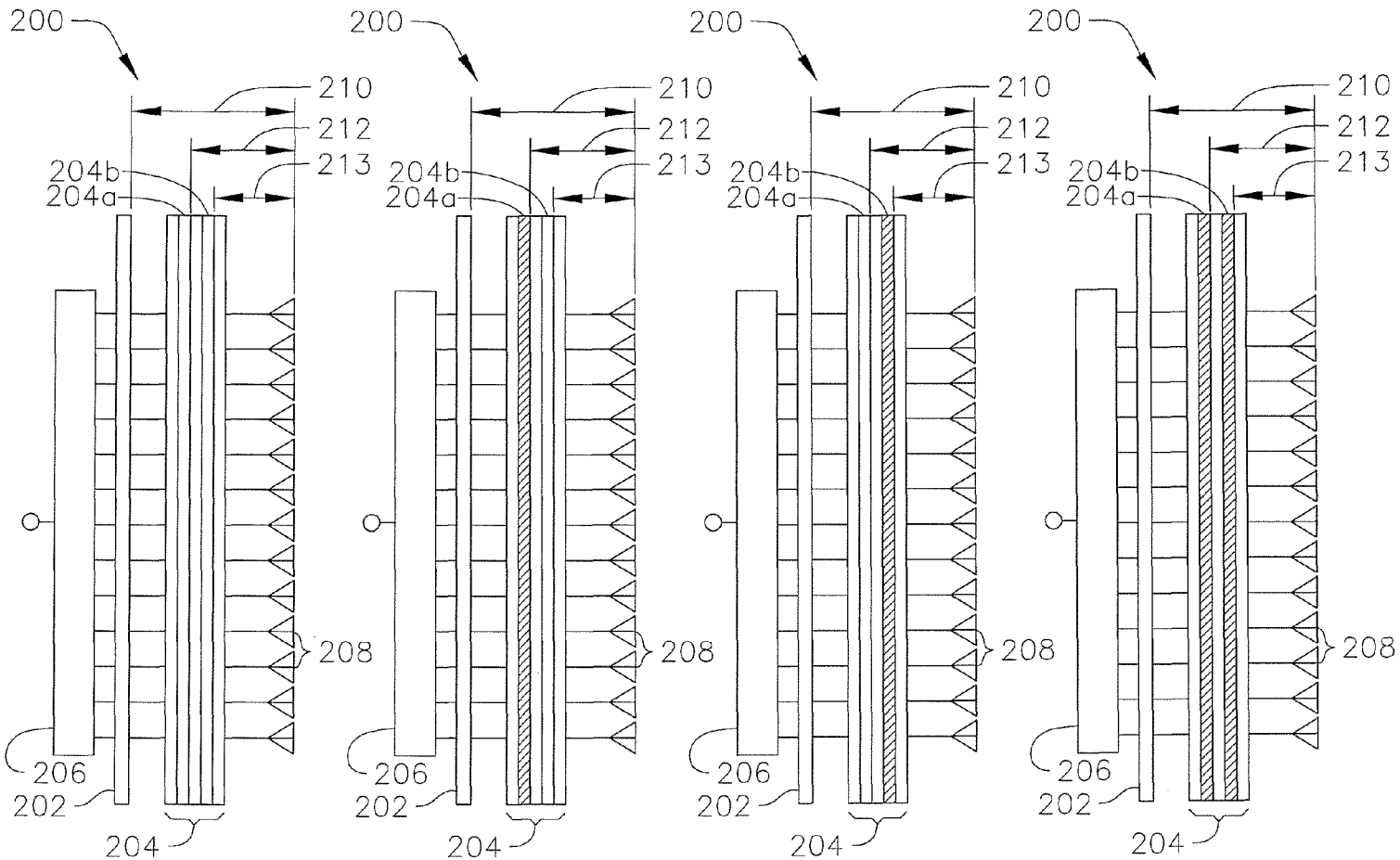
FIG. 6 is a side view of an antenna assembly including a first groundplane and a reconfigurable groundplane, in a transparent or passive mode, having first and second fluid cavities positioned at different distances from multiple radiating elements in accordance with one embodiment of the invention.
FIG. 7 is a side view of the antenna assembly of FIG. 6 where the reconfigurable groundplane has the first cavity filled and second cavity empty in accordance with a first active mode of the reconfigurable groundplane.
FIG. 8 is a side view of the antenna assembly of FIG. 6 where the reconfigurable groundplane has the first cavity empty and second cavity filled in accordance with a second active mode of the reconfigurable groundplane.
FIG. 9 is a side view of the antenna assembly of FIG. 6 where the reconfigurable groundplane has the first and second cavities filled in accordance with a third active mode of the reconfigurable groundplane.

FIG. 6 is a side view of an antenna assembly 200 including a first groundplane 202 and a reconfigurable groundplane 204, in a transparent or passive mode, having first and second fluid cavities (204*a*, 204*b*) positioned at different distances (212, 213) from multiple radiating elements 208 in accordance with one embodiment of the invention.

The first groundplane 202 is positioned between the RF feed 206 and the reconfigurable groundplane 204 and at one quarter of a wavelength 210 at a first preselected center frequency. The first groundplane can provide RF shielding for electronic components and transmission lines that are part of or located on the RF feed 206. These electronic components can include, for example, TR modules, phase shifters, manifolds, and other similar components. For a given frequency bandwidth, placement of the first groundplane behind the radiating elements by one quarter wavelength at the first preselected center frequency can provide optimum enhancement of the radiator performance (e.g., antenna performance) at the first preselected frequency.

The first fluid cavity 204*a* is positioned at a distance 212 from the radiating elements 208 corresponding to one quarter wavelength at a second preselected center frequency. The second preselected frequency is generally greater than the first preselected frequency. The second fluid cavity 204*b* is positioned at a distance 213 from the radiating elements 208 corresponding to one quarter wavelength at a third preselected center frequency. The third preselected frequency is generally greater than the second preselected frequency.

In operation, the reconfigurable groundplane 204 can have four modes. In a first mode, the passive or transparent mode, the first and second cavities (204*a*, 204*b*) of the reconfigurable groundplane 204 are substantially empty of any liquid metal and the reconfigurable groundplane is effectively transparent. In such case, the center frequency for optimum antenna performance is substantially dictated by the first groundplane 202 and the quarter wavelength distance 210 of the first groundplane. In a second mode, which is depicted in FIG. 7, the first cavity 204*a* of the reconfigurable groundplane 204 is substantially filled with a liquid metal material and the second cavity 204*b* is substantially empty of the liquid metal. In the second mode, the center frequency for optimum antenna performance is shifted to a second optimum center frequency.

In a third mode, which is shown in FIG. 8, the second cavity 204*b* of the reconfigurable groundplane 204 is substantially filled with the liquid metal material and the first cavity 204*a* is substantially empty of the liquid metal. In the third mode, the center frequency for optimum antenna performance is shifted again to a third optimum center frequency. In a fourth mode, both the first and second cavities (204*a*, 204*b*) of the reconfigurable groundplane 204 are substantially filled with the liquid metal material. In the fourth mode, which is illustrated in FIG. 9, the center frequency for optimum antenna performance is shifted again to a fourth optimum center frequency. As such, the reconfigurable groundplane 204 having two cavities can effectively realize different groundplanes that are a quarter wavelength away from the radiators at different frequencies from the original or first groundplane. As such, the reconfigurable groundplane enables optimum antenna performance at different center frequencies and across a wider frequency range than conventional antenna assemblies.

In the embodiment illustrated in FIG. 6, the reconfigurable groundplane has two cavities. In other embodiments, more than two cavities can be used to provide greater flexibility in configuring optimum performance across an even wider bandwidth. In some embodiments, either of the cavities of the reconfigurable groundplane can be filled with a first liquid metal in a first mode and a second liquid metal in a second mode. In such case, the first and second liquid metals can have sufficiently different characteristics as to provide additional flexibility in the optimum performance characteristic of the antenna assembly.

FIG. 7 is a side view of the antenna assembly of FIG. 6 where the reconfigurable groundplane has the first cavity filled and second cavity empty (second mode) in accordance with a first active mode of the reconfigurable groundplane.

FIG. 8 is a side view of the antenna assembly of FIG. 6 where the reconfigurable groundplane has the first cavity empty and second cavity filled (third mode) in accordance with a second active mode of the reconfigurable groundplane.

FIG. 9 is a side view of the antenna assembly of FIG. 6 where the reconfigurable groundplane has the first and second cavities filled (fourth mode) in accordance with a third active mode of the reconfigurable groundplane.

Figure 10:
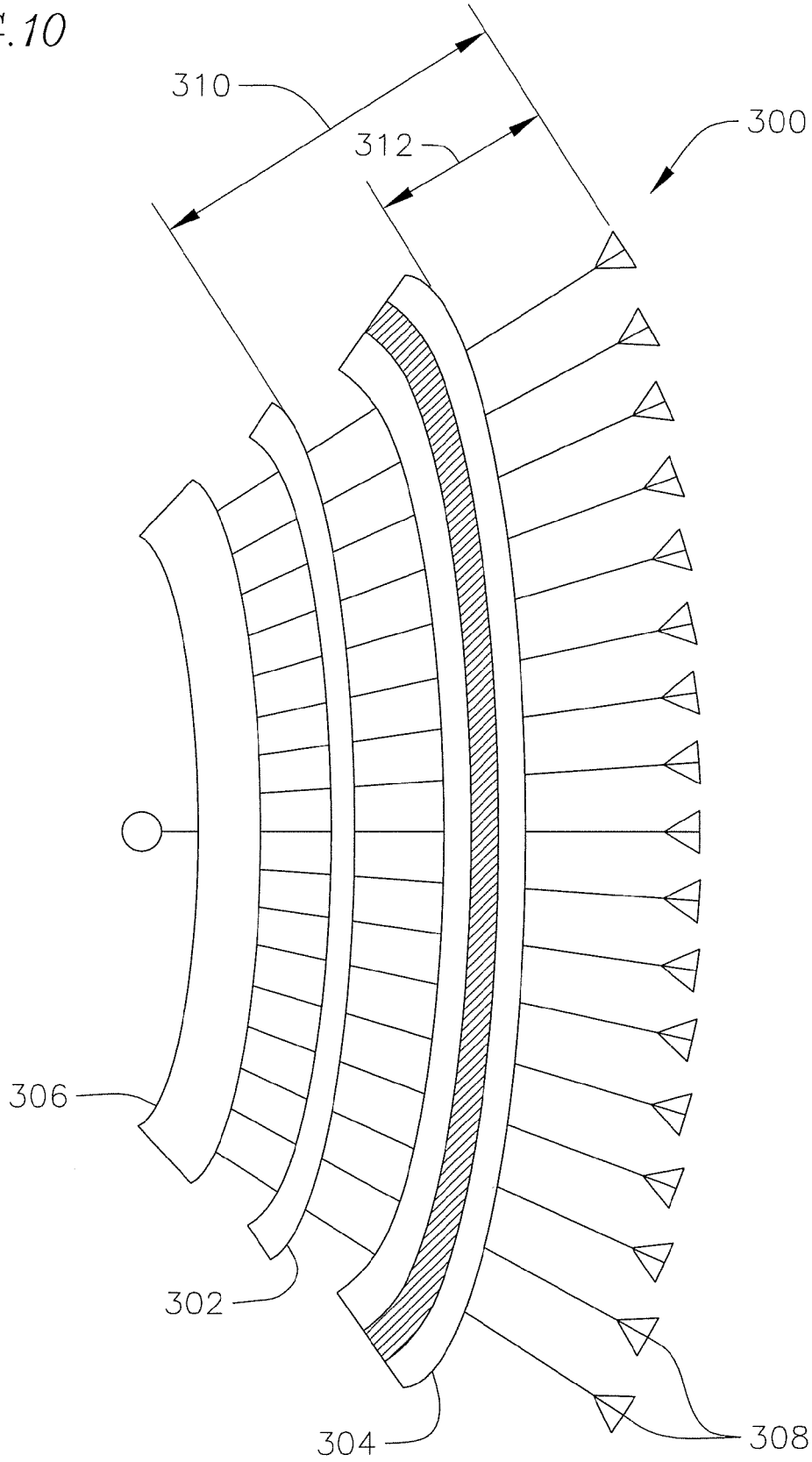
FIG. 10 is a side view of an antenna assembly including a first curved groundplane and a reconfigurable curved groundplane, in an active mode, positioned between an RF feed and multiple radiating elements in accordance with one embodiment of the invention.

FIG. 10 is a side view of an antenna assembly 300 including a first curved groundplane 302 and a reconfigurable curved groundplane 304, in an active mode, positioned between an RF feed 306 and multiple radiating elements 308 in accordance with one embodiment of the invention. The first curved groundplane 302 is positioned between the RF feed 306 and the reconfigurable groundplane 304 and at one quarter of a wavelength 310 at a first preselected center frequency. The reconfigurable groundplane 304 is positioned between the first groundplane 302 and the radiating elements 308 at one quarter of a wavelength 312 at a second preselected center frequency. The antenna assembly 300 and reconfigurable groundplane can operate as described above for any of the embodiments of FIGS. 1, 6-9. In the embodiment illustrated in FIG. 10, the reconfigurable curved groundplane 304 has a single cavity for retaining a liquid metal. In other embodiments, the reconfigurable curved groundplane can have more than one cavity for retaining liquid metal.

Figure 11:
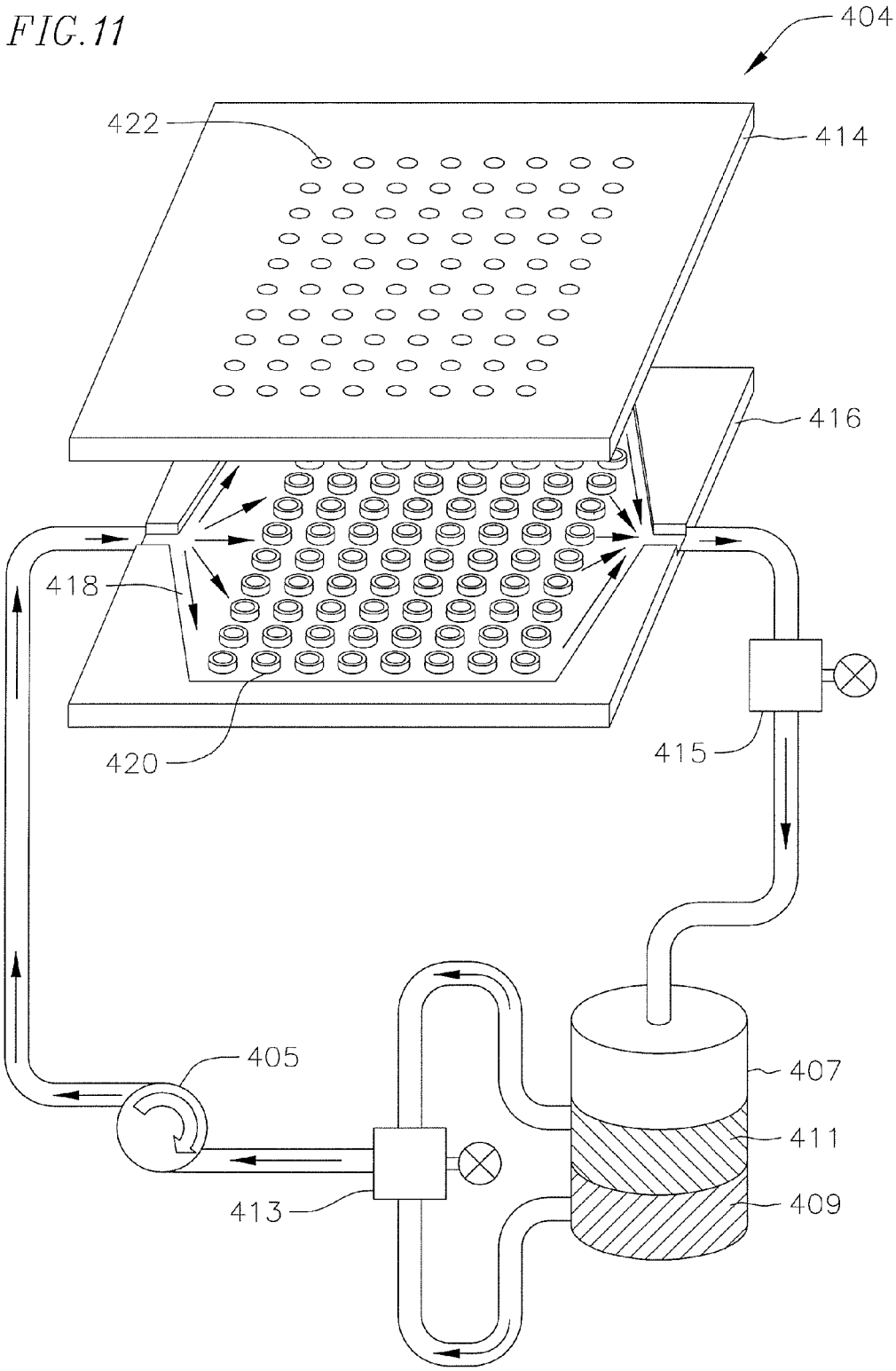
FIG. 11 is a perspective schematic view of a reconfigurable groundplane assembly including a reconfigurable groundplane, a pump and a separated fluid tank in accordance with one embodiment of the invention.

FIG. 11 is a perspective schematic view of a reconfigurable groundplane assembly including a reconfigurable groundplane 404 coupled to a pump 405 and a separated fluid tank 407 in accordance with one embodiment of the invention. The reconfigurable ground plane 404 includes a dielectric substrate cover 414 formed fuse with a dielectric substrate base 416. The dielectric substrate base 416 includes a cavity 418 for retaining a fluid, such as liquid metal or dielectric fluid, or a gas such as air. The dielectric substrate base 416 also includes multiple apertures or dielectric bosses 420 for forming clearance holes, along with holes 422 in the dielectric substrate cover 414, for radiator interconnects (see FIG. 5).

The dielectric substrate base 416 also has an inlet for receiving a liquid metal or liquid dielectric from pump 405 and an outlet for exiting liquid via valve 415 to the fluid tank 407. In the fluid tank 407, both the liquid metal 409 and liquid dielectric 411 are stored. Due to the physical properties of the liquids, they naturally separate themselves within the tank 407. In one embodiment, the liquid dielectric is a non-soluble low dielectric constant flushing fluid such as transformer oil. Two tank outlets are positioned at different heights of the tank to receive one of the separated fluids and each is coupled to a source control valve 413 that can select which liquid or fluid is pumped to the reconfigurable groundplane (414, 416). In several embodiments, the reconfigurable groundplane assembly and hydraulic system of FIG. 11 can be used in conjunction with any of the reconfigurable groundplanes described herein.

Figure 12:
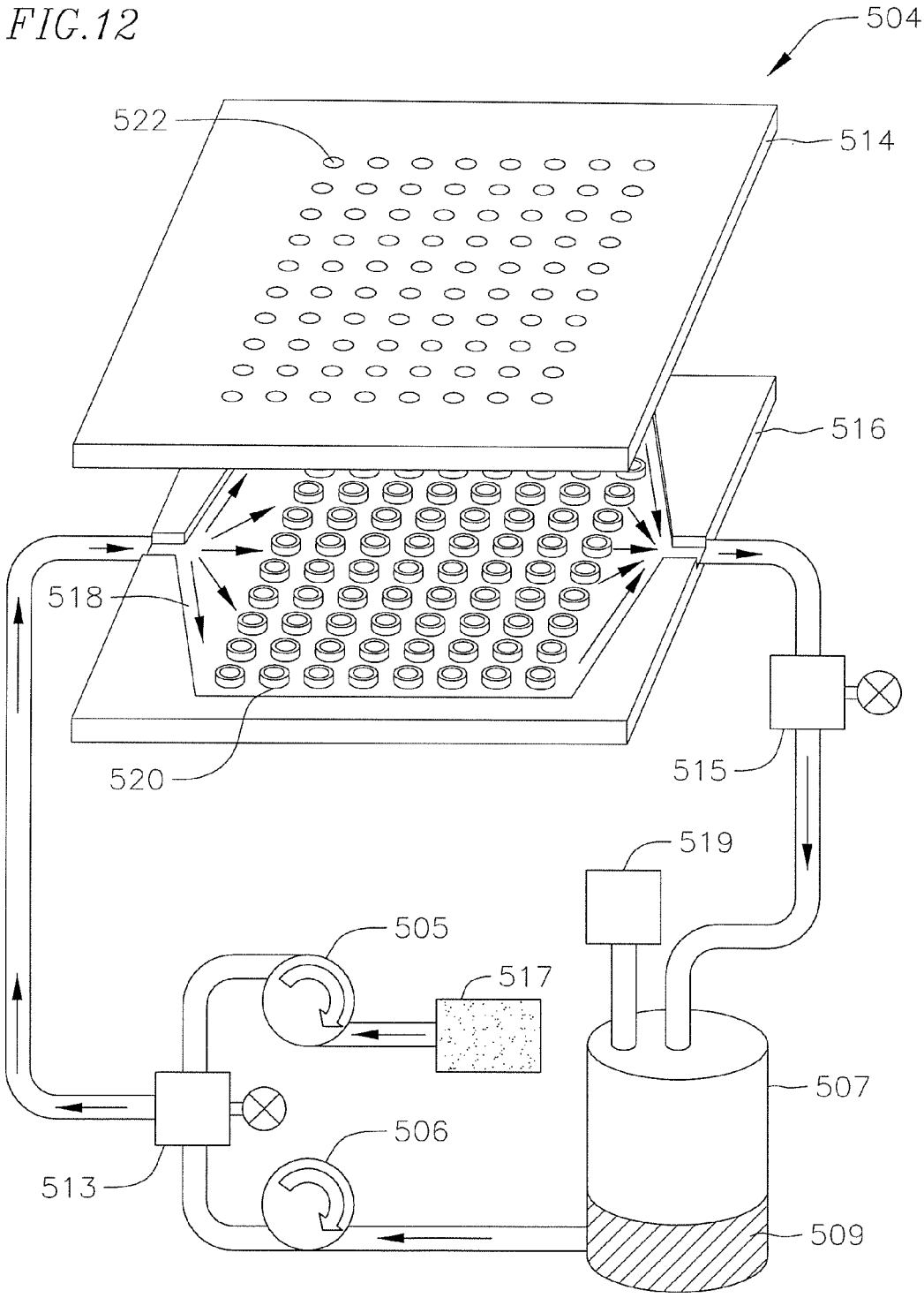
FIG. 12 is a perspective schematic view of a reconfigurable groundplane assembly including a reconfigurable groundplane, two pumps, an air tank, and a fluid tank in accordance with one embodiment of the invention.

FIG. 12 is a perspective schematic view of a reconfigurable groundplane assembly including a reconfigurable groundplane 504, two pumps (505, 507), an air tank/filter 517, and a fluid tank 507 in accordance with one embodiment of the invention. The reconfigurable ground plane 504 includes a dielectric substrate cover 514 formed to fuse with a dielectric substrate base 516. The dielectric substrate base 516 includes a cavity 518 for retaining a fluid, such as liquid metal or dielectric fluid, or a gas such as air. The dielectric substrate base 516 also includes multiple apertures or dielectric bosses 520 for forming clearance holes, along with holes 522 in the dielectric substrate cover 514, for radiator interconnects (see FIG. 5). The dielectric substrate base 516 also has an inlet for receiving a liquid metal from pump 506 or air dielectric from pump 505 and an outlet for exiting the liquid metal or air via valve 515 to the fluid tank 507. In the fluid tank 507, liquid metal 509 is stored and any air dielectric received can be dispersed to the outside via release valve 519.

When activated, pump 506 draws the liquid metal 509 from the tank 507 and provides it to the inlet of reconfigurable ground plane 504. When activated, pump 505, which can be a high velocity air blower or other suitable device, draws air from outside via an air filter/tank 517 and provides it to the inlet of reconfigurable ground plane 504. Selector valve, or source control valve, 513 selects between liquid metal provided by pump 506 and air dielectric provided by pump 505 in accordance with the desired material to be pumped into the reconfigurable groundplane cavity. In several embodiments, control circuitry (not shown) is coupled to each component of the reconfigurable groundplane assembly to properly coordinate activation of the pumps and valves. In several embodiments, the reconfigurable groundplane assembly and hydraulic system of FIG. 12 can be used in conjunction with any of the reconfigurable groundplanes described herein.

Figure 13:
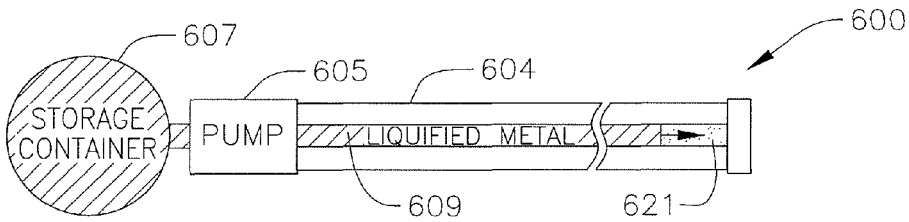
FIG. 13 is a schematic block diagram of a reconfigurable groundplane assembly including a reconfigurable groundplane, a fluid tank, and a pump for controlling the flow of fluid into and out of the reconfigurable groundplane in accordance with one embodiment of the invention.

FIG. 13 is a schematic block diagram of a reconfigurable groundplane assembly 600 including a reconfigurable groundplane 604, a fluid or storage tank 607, and a pump 605 for controlling the flow of fluid into and out of the reconfigurable groundplane in accordance with one embodiment of the invention. The reconfigurable groundplane 604 includes a cavity that is partially filled with a liquid metal 609 and partially filled with a small amount of air dielectric 621. In one embodiment, the reconfigurable groundplane can operate in any of the methods described above. In another embodiment, the fluidic cavity can include a valve that only allows air to exit or enter based on a particular amount of applied pressure. In several embodiments, the reconfigurable groundplane assembly and hydraulic system of FIG. 13 can be used in conjunction with any of the reconfigurable groundplanes described herein.

Figure 14:
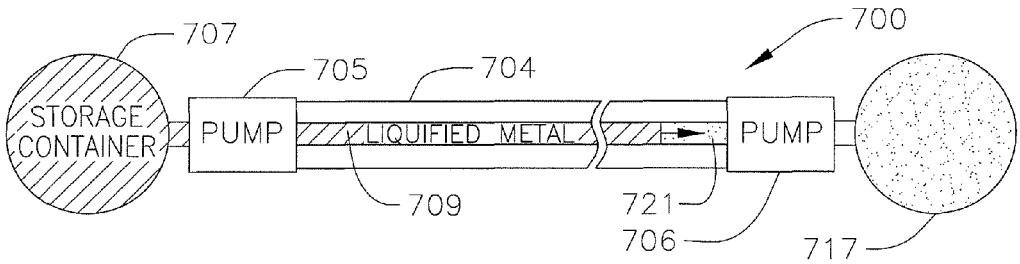
FIG. 14 is a schematic block diagram of a reconfigurable groundplane assembly including a reconfigurable groundplane, a tank of liquid metal, a fluid pump, an air tank and an air pump for controlling the flow of fluid into and out of the reconfigurable groundplane in accordance with one embodiment of the invention.

FIG. 14 is a schematic block diagram of a reconfigurable groundplane assembly 700 including a reconfigurable groundplane 704, a fluid tank 707, a fluid pump 705, an air tank 717 and an air pump 706 for controlling a flow of fluid into and out of the reconfigurable groundplane in accordance with one embodiment of the invention. The reconfigurable groundplane 704 includes a cavity that is partially filled with a liquid metal 709 and partially filled with a small amount of air dielectric 721. The fluid pump 705 and air pump 706 can be used in conjunction with one another to fill the cavity with the liquid metal 709 and to fill the cavity with air dielectric 721. In one embodiment, the assembly includes additional control circuitry for controlling the pumps and other appropriate components to substantially fill and empty the cavity of liquid metal in conjunction with operation of the antenna. In several embodiments, the reconfigurable groundplane can operate using any of the methods described above. In several embodiments, the reconfigurable groundplane assembly and hydraulic system of FIG. 14 can be used in conjunction with any of the reconfigurable groundplanes described herein.

Figure 15:
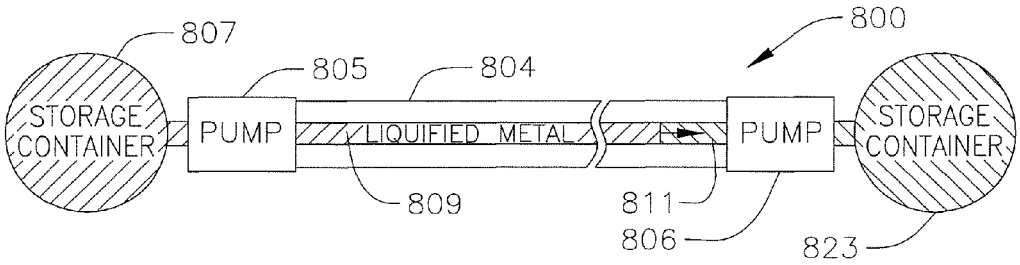
FIG. 15 is a schematic block diagram of a reconfigurable groundplane assembly including a reconfigurable groundplane, a tank of liquid metal, a liquid metal pump, a tank of liquid dielectric and a dielectric pump for controlling a flow of fluid into and out of the reconfigurable groundplane in accordance with one embodiment of the invention.

FIG. 15 is a schematic block diagram of a reconfigurable groundplane assembly 800 including a reconfigurable groundplane 804, a tank of liquid metal 807, a liquid metal pump 805, a tank of liquid dielectric 823 and a dielectric pump 806 for controlling a flow of fluid into and out of the reconfigurable groundplane in accordance with one embodiment of the invention. The reconfigurable groundplane 804 includes a cavity that is partially filled with a liquid metal 809 and partially filled with a small amount of liquid dielectric 811. The fluid pump 805 and dielectric pump 806 can be used in conjunction with one another to fill the cavity with the liquid metal 809 and to fill the cavity with liquid dielectric 811. In one embodiment, the assembly includes additional control circuitry for controlling the pumps and other appropriate components to substantially fill and empty the cavity of liquid metal in conjunction with operation of the antenna. In several embodiments, the reconfigurable groundplane can operate using any of the methods described above. In several embodiments, the reconfigurable groundplane assembly and hydraulic system of FIG. 15 can be used in conjunction with any of the reconfigurable groundplanes described herein.

FIG. 16 is a table of melting points for various alloys that might be used as a liquid metal in accordance with one embodiment of the invention.

Figure 17:
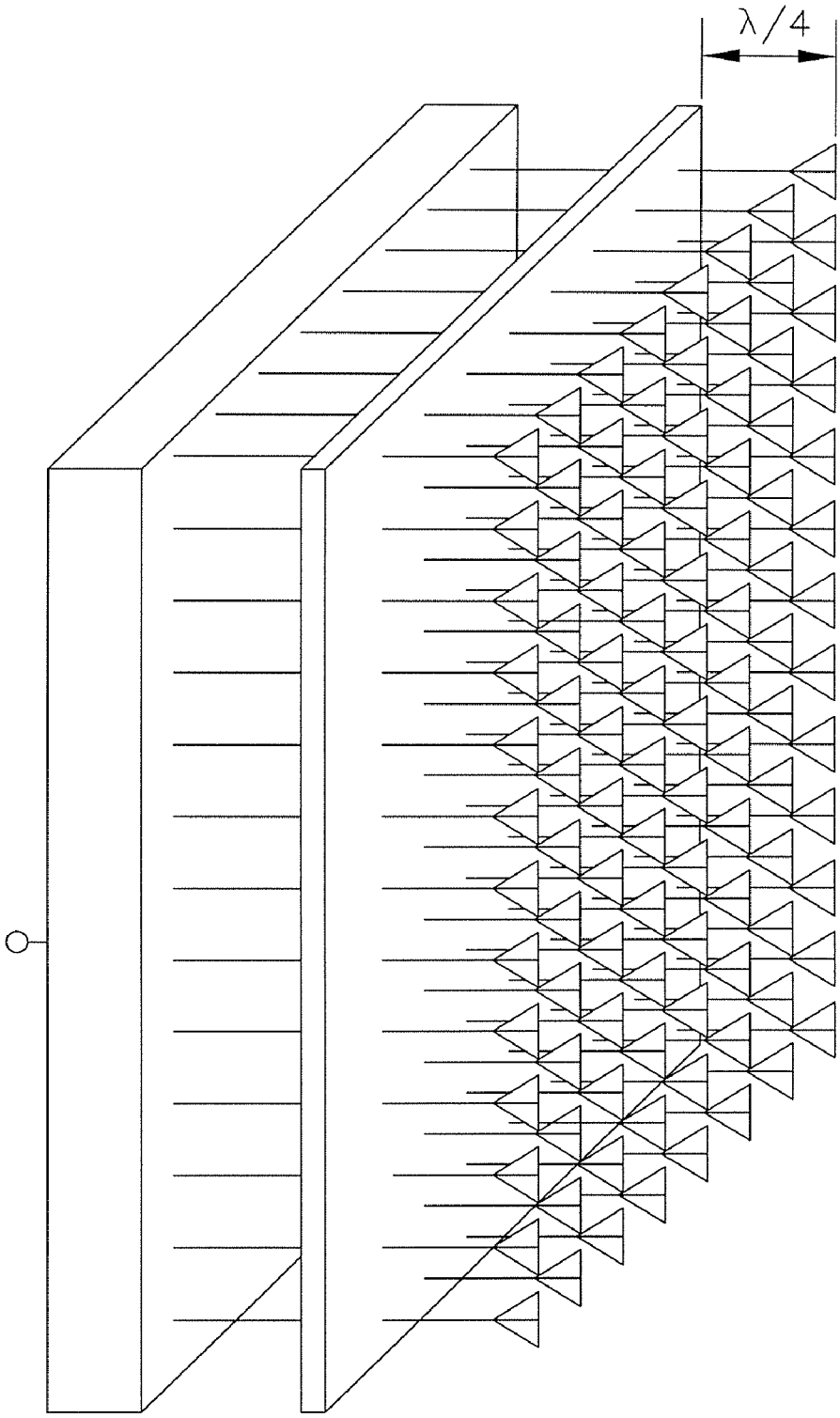
FIG. 17 illustrates a convention active phase array antenna having a single non-reconfigurable groundplane positioned at a quarter wavelength from the radiating elements of the antenna.

FIG. 17 illustrates a convention active phase array antenna having a single non-reconfigurable groundplane positioned at a quarter wavelength from the radiating elements of the antenna.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. An antenna assembly having a reconfigurable groundplane, the assembly comprising:
- a radio frequency (RF) feed;
- a plurality of radiating elements;
- a plurality of interconnects, each coupling one of the plurality of radiating elements to the RF feed;
- a first groundplane positioned between the RF feed and the plurality of radiating elements; and
- a second groundplane positioned between the RF feed and the plurality of radiating elements, the second groundplane comprising at least one cavity for enclosing a liquid metal and a plurality of apertures each configured to receive one of the plurality of interconnects.

2. The assembly of claim 1:
- wherein, in a first mode, the at least one cavity of the second groundplane is configured to be substantially empty of the liquid metal; and
- wherein, in a second mode, the at least one cavity of the second groundplane is configured to be substantially filled with the liquid metal.

3. The assembly of claim 2:
- wherein, in the first mode, the second groundplane is configured to be substantially transparent; and
- wherein, in the second mode, the second groundplane is configured to perform substantially as a groundplane.

4. The assembly of claim 1, wherein the first groundplane is positioned at a distance of approximately a quarter wavelength from the plurality of radiating elements at a first preselected frequency.

5. The assembly of claim 4, wherein the second groundplane is positioned at a distance of approximately a quarter wavelength from the plurality of radiating elements at a second preselected frequency, wherein the second preselected frequency is greater than the first preselected frequency.

6. The assembly of claim 1, wherein the second groundplane comprises a dielectric substrate.

7. The assembly of claim 6, wherein the dielectric substrate comprises a shape having a flat surface.

8. The assembly of claim 6, wherein the dielectric substrate comprises a shape having a curved surface.

9. The assembly of claim 8, wherein the first groundplane comprises a shape having a curved surface.

10. The assembly of claim 6, wherein the dielectric substrate comprises:
- a first dielectric sheet comprising the at least one cavity; and
- a second dielectric sheet fused to the first dielectric sheet thereby enclosing the at least one cavity.

11. The assembly of claim 10, wherein the first dielectric sheet comprises:
- a plurality of bosses in contact with the second dielectric sheet for forming the plurality of apertures.

12. The assembly of claim 1, wherein the antenna assembly is configured to provide substantially optimized performance at two different preselected frequencies.

13. The assembly of claim 1, wherein the liquid metal comprises Galinstan.

14. The assembly of claim 1, further comprising:
- a pump coupled to an inlet of first cavity of the at least one cavity; and
- a tank comprising liquid metal, the tank coupled to the pump and an outlet of the first cavity.

15. The assembly of claim 14, further comprising:
- a selector valve coupled between the pump and the tank,
- wherein the tank comprises a liquid dielectric that is configured to separate itself from the liquid metal in the tank,
- wherein the selector valve is coupled to a first location on the tank to receive the liquid metal and a second location on the tank to receive the liquid dielectric.

16. The assembly of claim 14, further comprising:
- a second pump for pumping a dielectric material into the first cavity; and
- a selector valve, coupled to the pump and the second pump, for selecting from the dielectric material or liquid metal to be provided to the first cavity;
- wherein the pump is configured to draw liquid metal from the tank and provide the liquid metal to the selector valve.

17. The assembly of claim 16, wherein the dielectric material is air.

18. The assembly of claim 16, wherein the dielectric material is a liquid dielectric.

19. The assembly of claim 1, wherein at least one of the plurality of interconnnects extends through one of the plurality of apertures to connect the RF feed to one of the plurality of radiating elements.

20. The assembly of claim 1, wherein each of the plurality of interconnnects extends through one of the plurality of apertures to connect the RF feed to one of the plurality of radiating elements.

21. An antenna assembly having a reconfigurable groundplane, the assembly comprising:
- a radio frequency (RF) feed;
- a plurality of radiating elements;
- a plurality of interconnects, each coupling one of the plurality of radiating elements to the RF feed;
- a first groundplane positioned between the RF feed and the plurality of radiating elements; and a second groundplane positioned between the RF feed and the plurality of radiating elements, the second groundplane comprising at least one cavity for enclosing a liquid metal;

wherein the second groundplane comprises first and second cavities for enclosing the liquid metal.

22. The assembly of claim 21:

wherein, in a first mode, the first and second cavities are configured to be substantially empty of the liquid metal;

wherein, in a second mode, the first cavity is configured to be substantially filled with the liquid metal and the second cavity is configured to be substantially empty of the liquid metal;

wherein, in a third mode, the first cavity is configured to be substantially empty of the liquid metal and the second cavity is configured to be substantially filled of the liquid metal; and wherein, in a fourth mode, the first and second cavities are configured to be substantially filled with the liquid metal.

23. The assembly of claim 22:

wherein, in the first mode, the second groundplane is configured to be substantially transparent and the antenna assembly is configured to perform optimally at a first preselected frequency;

wherein, in the second mode, the second groundplane is configured to perform substantially as a groundplane and the antenna assembly is configured to perform optimally at a second preselected frequency;

wherein, in the third mode, the second groundplane is configured to perform substantially as a groundplane and the antenna assembly is configured to perform optimally at a third preselected frequency;

wherein, in the fourth mode, the second groundplane is configured to perform substantially as a groundplane and the antenna assembly is configured to perform optimally at a fourth preselected frequency; and wherein the first, second, third, and fourth preselected frequencies are different frequencies.

24. An antenna assembly having a reconfigurable groundplane, the assembly comprising:

a radio frequency (RF) feed;

a plurality of radiating elements; and a plurality of interconnects, each coupling one of the plurality of radiating elements to the RF feed; and wherein the reconfigurable groundplane is positioned between the RF feed and the plurality of radiating elements, the reconfigurable groundplane comprising at least one cavity for enclosing a liquid metal and a plurality of apertures each configured to receive one of the plurality of interconnects.

25. A method for operating a reconfigurable groundplane of an antenna assembly comprising a radio frequency (RF) feed coupled by a plurality of interconnects to a plurality of radiating elements, the method comprising:

substantially filling, in a first mode, a cavity of the reconfigurable groundplane with a liquid metal, wherein the reconfigurable groundplane is positioned between the RF feed and the radiating elements and comprises a plurality of apertures each configured to receive one of the plurality of interconnects; and substantially emptying, in a second mode, the cavity.

* * * * *